US006945602B2

(12) United States Patent
Fookes et al.

(10) Patent No.: US 6,945,602 B2
(45) Date of Patent: Sep. 20, 2005

(54) TILT CONTROL MECHANISM FOR CHAIR

(75) Inventors: Tim Fookes, Grandville, MI (US); Jason M. Rose, Kentwood, MI (US)

(73) Assignee: Haworth, Inc., Holland, MI (US)

( * ) Notice: Subject to any disclaimer, the term of this patent is extended or adjusted under 35 U.S.C. 154(b) by 90 days.

(21) Appl. No.: 10/739,642

(22) Filed: Dec. 18, 2003

(65) Prior Publication Data

US 2005/0146185 A1 Jul. 7, 2005

(51) Int. Cl.[7] ..... A47C 1/032
(52) U.S. Cl. ..... 297/300.4; 297/300.2; 297/321
(58) Field of Search ..... 297/300.1, 300.2, 297/300.4, 316, 320, 321

(56) References Cited

U.S. PATENT DOCUMENTS

| | | | |
|---|---|---|---|
| 2,447,601 | A | 8/1948 | Sengpiel |
| 2,859,801 | A | 11/1958 | Moore |
| 3,072,436 | A | 1/1963 | Moore |
| 4,375,301 | A | 3/1983 | Pergler et al. |
| 4,429,917 | A | 2/1984 | Diffrient |
| 4,502,729 | A | 3/1985 | Locher |
| 4,666,121 | A | 5/1987 | Choong et al. |
| 4,684,173 | A | 8/1987 | Locher |
| 4,709,962 | A | 12/1987 | Steinmann |
| 4,776,633 | A | 10/1988 | Knoblock et al. |
| 4,779,925 | A | 10/1988 | Heinzel |
| 4,966,411 | A | 10/1990 | Katagiri et al. |
| 4,979,778 | A | 12/1990 | Shields |
| 4,988,145 | A | 1/1991 | Engel |
| 5,005,905 | A | 4/1991 | Sondergedl |
| 5,042,876 | A | 8/1991 | Faiks |
| 5,071,189 | A | 12/1991 | Kratz |
| 5,318,345 | A | 6/1994 | Olson |
| 5,333,368 | A | 8/1994 | Kriener et al. |
| 5,348,372 | A | 9/1994 | Takamatsu et al. |
| 5,354,120 | A | 10/1994 | Voelkle |
| 5,366,274 | A | 11/1994 | Roericht et al. |
| 5,582,459 | A | 12/1996 | Hama et al. |
| 5,725,277 | A | 3/1998 | Knoblock |
| 5,772,282 | A | 6/1998 | Stumpf et al. |
| 5,775,774 | A | 7/1998 | Okano |
| 5,806,930 | A | 9/1998 | Knoblock |
| 5,810,439 | A | 9/1998 | Roslund, Jr. |
| 6,382,723 | B1 | 5/2002 | Piretti |

(Continued)

FOREIGN PATENT DOCUMENTS

| | | |
|---|---|---|
| EP | 0 250 207 | 12/1987 |
| EP | 0 784 952 | 7/1997 |

*Primary Examiner*—Peter R. Brown
(74) *Attorney, Agent, or Firm*—Flynn, Thiel, Boutell & Tanis, P.C.

(57) ABSTRACT

A chair back is supported on a rigid upright coupled to a horizontal tilt shaft disposed under the front of the chair seat and supported on a control housing fixed to a pedestal. A tension mechanism urges the upright into an upright position. The chair seat is movably supported on the upright by an arrangement which permits the seat to pivot about a transverse horizontal axis positioned adjacent the upper surface of the seat. A control link is pivoted at one end to the control housing, and the other end has lost-motion pivotal connections to the seat frame and the upright. The lost-motion pivotal connection to the seat frame including a spring cooperating between the upright and the seat frame to allow the seat to move relative to the upright.

15 Claims, 12 Drawing Sheets

U.S. PATENT DOCUMENTS 6,386,634 B1 5/2002 Stumpf et al.
6,425,633 B1 7/2002 Wilkerson et al.
6,431,649 B1 8/2002 Hensel
6,439,661 B1 8/2002 Brauning
6,609,755 B2 * 8/2003 Koepke et al. ..... 297/300.2
6,644,741 B2 11/2003 Nelson et al.
6,709,058 B1 * 3/2004 Diffrient ..... 297/320
6,722,741 B2 * 4/2004 Stumpf et al. ..... 297/300.2

* cited by examiner

TILT CONTROL MECHANISM FOR CHAIR

FIELD OF THE INVENTION

This invention relates to an office-type chair, and more specifically relates to an improved synchrotilt mechanism coupled to the seat and back of the chair for providing improved seating comfort.

BACKGROUND OF THE INVENTION

Office chairs conventionally provide some type of rearward tilting movement. In its simplest variations, the rear tilting involves solely the back, or the seat and back as a unitary construction. To provide improved and more desirable tilting movement and seating comfort, however, many office-type chairs employ a synchrotilt mechanism coupled between the chair base and the seat-back assembly, for permitting the seat and back to simultaneously tilt at different rates, with the tilt rate and maximum tilt angle of the back typically being about twice the tilt rate and maximum tilt angle of the seat.

Chairs employing synchrotilt mechanisms for permitting simultaneous but relative tilting of the seat and back are well known, and numerous mechanisms have been developed for performing this function. Most of these mechanisms, however, have caused relative motion between the chair and the seated occupant which has interfered with occupant comfort. Such relative motion may involve relative sliding between the seat and the occupant's hips or thighs, and/or sliding between the chair back and the occupant's back, during the relative tilting between the seat and back. In an attempt to alleviate or at least partially compensate for this problem, several chair mechanisms have been developed which cause the seat, during rearward tilting of the seat-back arrangement, to tilt relative to the back about an axis located approximately at the hip axis of the seated occupant. This hip axis is disposed in upwardly spaced relation from the rear portion of the seat, and spaced forwardly from the lower portion of the chair back. While locating the relative tilt axis between the seat and back at the occupant's hip axis is believed to provide improved performance, particularly with respect to minimizing the relative sliding motion between the seated occupant and the seat/back, nevertheless many of these known mechanisms still fail to provide the degree of performance desired, particularly with respect to the desired comfort and ease of movement (often referred to as "ride") associated with tilting of the chair.

Copending application Ser. No. 09/957,695 filed Sep. 20, 2001, now U.S. Pat. No. 6,644,741, owned by the Assignee hereof, discloses a chair with a synchrotilt mechanism which is believed to provide improved control over the relative but synchronized tilting of the back and seat so as to provide improved occupant comfort and ride while minimizing relative sliding movement between the seated occupant and the back and/or seat of the chair. The synchrotilt mechanism of this chair employs a seat cradle pivotally supported on a back upright, the latter being pivoted from the chair base, and a tilt control linkage cooperatively coupled between the base, seat cradle and upright so that seat tilting occurs generally about an axis disposed above the seat cradle but slightly below an upper surface of the unoccupied seat. The tilt control linkage includes a first lower link pivotally connected at a forward end to the base, a second upper link pivotally connected at a forward end to the seat cradle, and rearward ends of the first and second links pivotally joined to one another and carrying thereon a roller or slide movably captivated within an elongate slot formed within the upright. The forward end of the first link is also pivotally supported within an elongate slot formed in the base, and cooperates with a suitable spring device at this forward end to permit limited forward tilting of the seat cradle relative to the remainder of the chair in response to forward leaning of the chair occupant.

While the aforementioned chair provides desirable performance and seating comfort, nevertheless it has been observed that the synchrotilt mechanism and the tilt control linkage associated therewith require a significant number of parts as well as pivotal connections, which in turn increases the complexity of the chair assembly with respect to required manipulations and assembly time. This linkage also is more space-consuming, particularly in view of the limited available space, and this additionally increases the complexities associated with assembly of the chair.

Accordingly, it is an object of this invention to provide an improved synchrotilt mechanism for a chair which retains the desirable performance, both with respect to control and ride, associated with the chair of Assignee's aforementioned application, but which is able to provide this desirable performance while utilizing a simplified synchrotilt control mechanism which is structurally less complex, occupies less space, is easier to assemble, and is consequently less costly.

More specifically, in the improved chair of this invention, the synchrotilt mechanism employs a seat cradle pivotally supported on the back upright for relative pivoting about an axis typically disposed in the vicinity of the upper surface of the seat, with the relative motion between the seat cradle and back upright being controlled by a tilt control linkage which couples the seat cradle and back upright to the chair base. The tilt control linkage has an elongate control link which at a front end is pivoted to the chair base about a first transverse horizontal axis, which control link at its rearward end has a slide or roller movably engaged within an elongate slot associated with a base leg of the back upright. This control link, where it joins to the back upright, also has a bias or spring arrangement coupled between the seat cradle and the rearward end of the control link to provide a spring-controlled lost motion connection with the seat cradle whereby, during normal rearward tilting of the back upright, the seat cradle also tilts rearwardly but at a lesser rate as permitted by compression of the spring between the control link and the seat cradle. This same spring and the lost motion connection defined thereby also enables the seat cradle to tilt forwardly a limited extent in response to forward leaning of the chair occupant to provide a simple forward tilt function at least when the chair is in the normal upright position.

Other objects and purposes of the invention will be apparent to persons familiar with constructions of this general type upon reading the following specification and inspecting the accompanying drawings.

Figure 1:
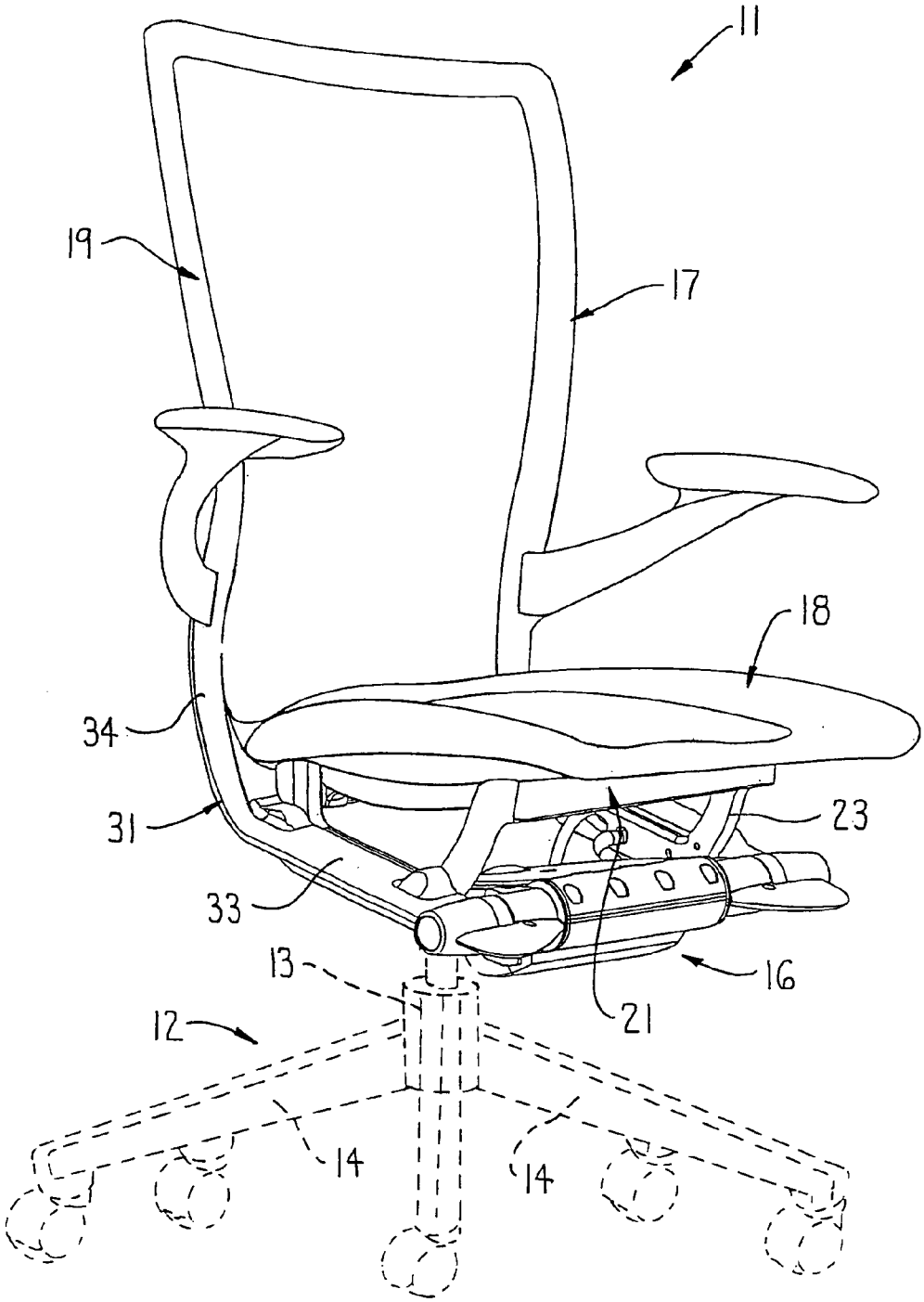
FIG. 1 is a perspective view of an office-type chair employing the improved tilt control mechanism of the present invention.
Figure 2:
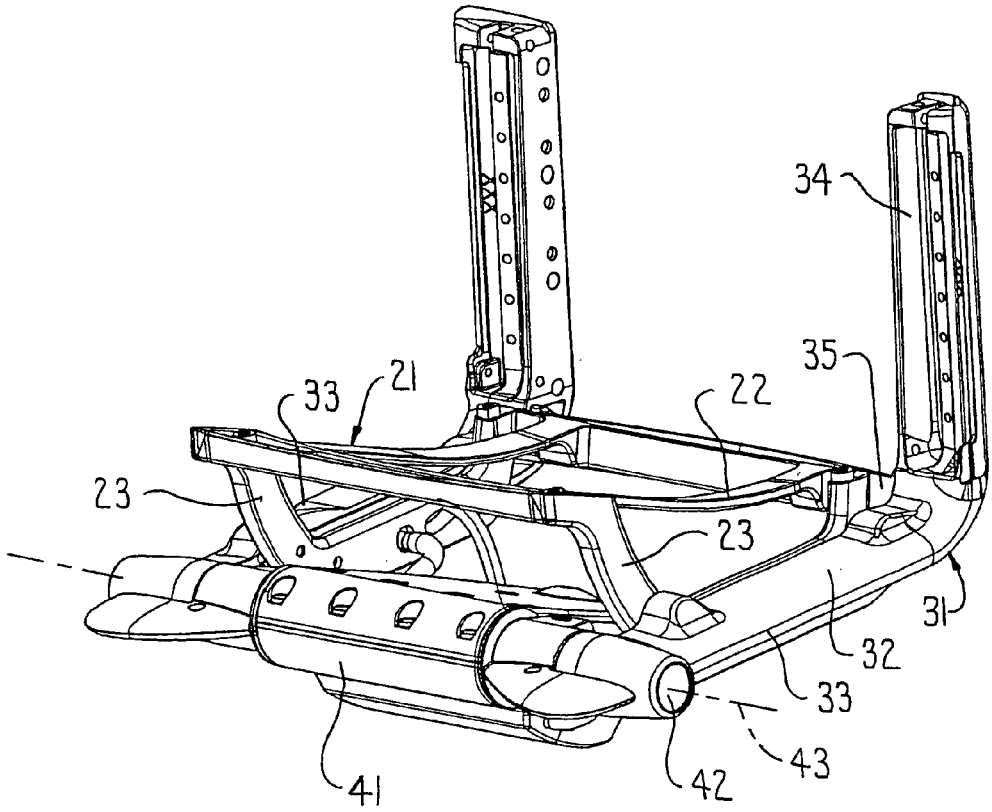
FIG. 2 is a perspective view showing the seat cradle assembled to the upright structure and additionally showing the connection to the chair control housing.
Figure 3:
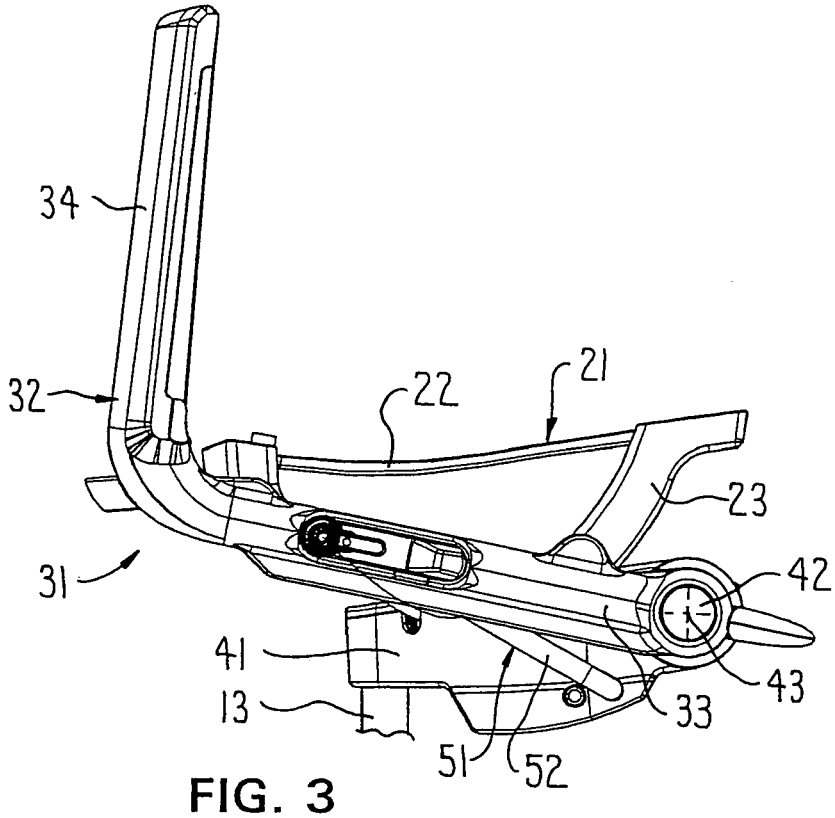
FIG. 3 is a side elevational view of the assembly shown in FIG. 2.
Figure 4:
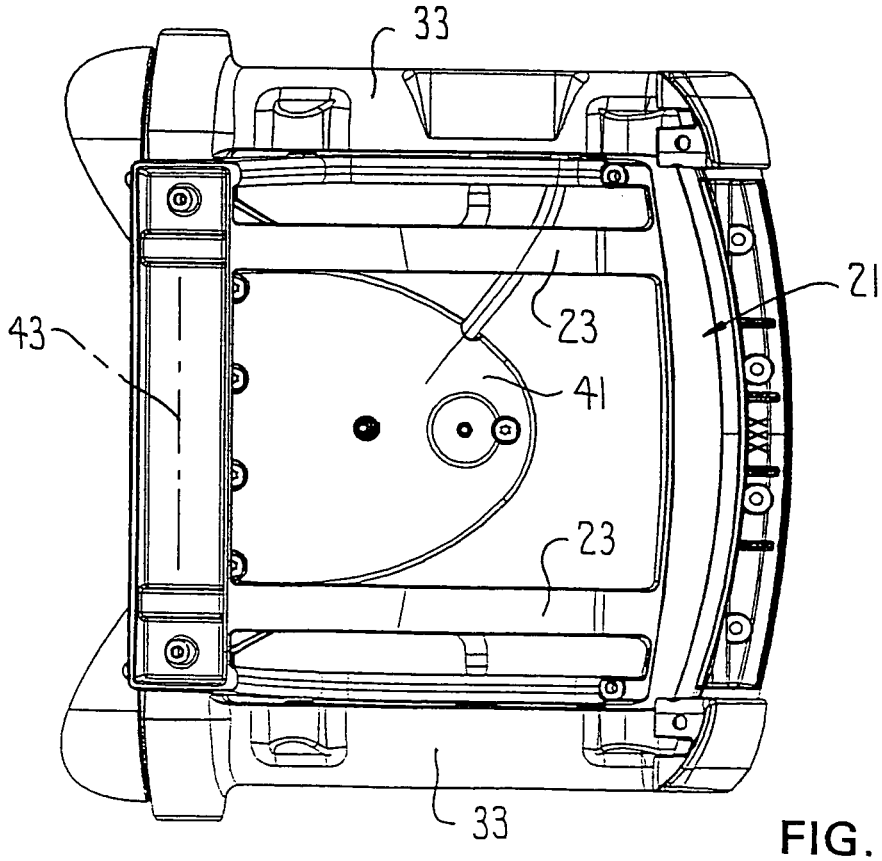
FIG. 4 is a top view of the assembly shown in FIG. 3.
Figure 5:
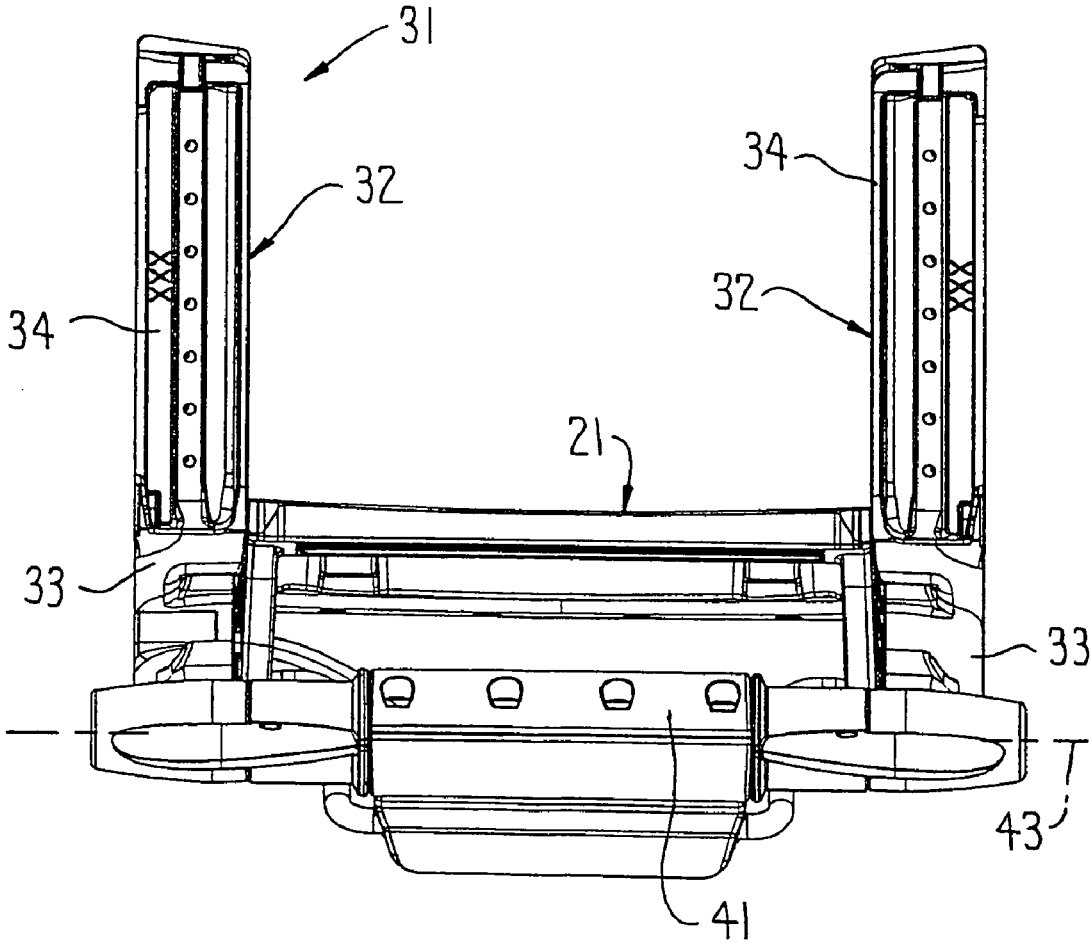
FIG. 5 is a front view of the assembly shown in FIG. 3.

Certain terminology will be used in the following description for convenience in reference only, and will not be limiting. For example, the words "upwardly", "downwardly", "rightwardly" and "leftwardly" will refer to directions in the drawings to which reference is made. These latter terms will also refer to the normal directions and positional orientations associated with a person sitting in the chair. The words "inwardly" and "outwardly" will refer to directions toward and away from, respectively, the geometric center of the chair and designated parts thereof. Said terminology will include the words specifically mentioned, derivatives thereof, and words of similar import.

DETAILED DESCRIPTION

Referring to FIG. 1, there is illustrated a chair 11 which incorporates therein the improved synchrotilt control according to the present invention. The chair 11 includes a base 12 provided with a plurality of legs 14 which radiate outwardly and are provided with casters for rolling support on a floor. The base 12, centrally thereof, has a height-adjustable pedestal 13 which projects upwardly and, at the upper end thereof, couples to a chair control 16, the latter in turn providing support for an L-shaped seat-back arrangement 17 which includes a seat assembly 18 and a back assembly 19.

The seat assembly 18 includes a rigid seat frame or cradle 21 defined by a generally rectangular ring-shaped top frame 22 which, adjacent opposite sides, is provided with generally parallel side frame elements 23. The elements 23 are generally U-shaped and protrude downwardly, with upper ends of the legs being rigidly joined adjacent the front and rear corners of the top frame 22.

The seat assembly 18 also includes a thin sheetlike seat shell 24 stationarily positioned on the upper surface of the top frame 22, and a compressible seat cushion 25 supported on and extending generally coextensively over the upper surface of the seat shell 24. The cushion 25 terminates in respective front and rear edges 26 and 27, the latter being defined in close proximity to the back assembly 19. The seat cushion defines thereon an upper surface 28 disposed for contacting engagement with a chair occupant. The seat cushion 25, when engaged with a seated occupant, resiliently deforms downwardly so that the upper surface 28, at least in the main central region of the cushion where engaged with the occupant, is deflected downwardly from the nondeformed position indicated in FIGS. 6 and 7.

The back assembly 19 is supported on a generally rigid upright structure 31 which is defined by a pair of generally parallel and sidewardly positioned L-shaped side upright elements or members 32, each of which has a lower lever arm portion 33 positioned below the seat shell 24 and which, at a rearward end, is joined through an integral bend to an upper arm portion 34 which is cantilevered upwardly and has the back assembly 19 mounted thereon. The sidewardly spaced uprights 32 are, adjacent the lower ends of the upper arm portions 34, rigidly joined by a cross member 35 extending therebetween.

The forward ends of the lower lever arm portions 33 are nonrotatably connected to a tilt shaft 42 which defines a rotational axis 43 extending generally horizontally in transverse relationship relative to the seat assembly 18. The tilt shaft 42 is rotatably supported within a housing or support arm 41 which is fixed to the upper end of the height-adjusting pedestal 13, with the housing 41 being cantilevered forwardly from the pedestal so that the tilt shaft 42 is positioned under but more closely adjacent the front edge 26 of the seat cushion 25.

The tilt shaft 42 projects outwardly through openings 44 formed in opposite sides of the housing 41 so that opposite end portions of the tilt shaft 42 are disposed on opposite sides of the housing 41. The projecting end portions of the shaft 42 in turn project through openings 45 associated with the forward ends of the lower lever arm portions 33, with these latter arm portions being keyed or otherwise suitably nonrotatably secured to the shaft 42, whereby the rigid upright arrangement 31 is angularly movable about the horizontal axis 43 in correspondence with angular displacement of the tilt shaft 42.

Figure 11:
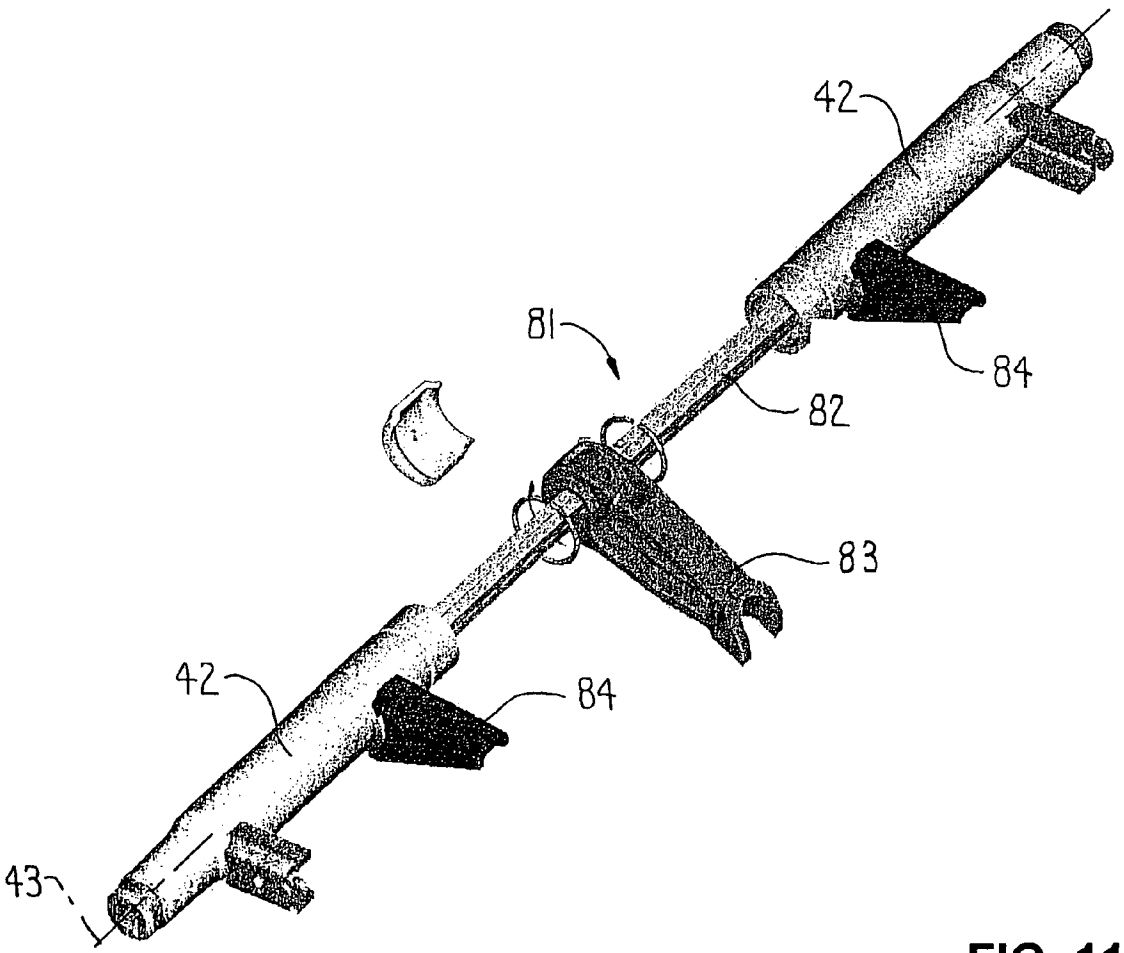
FIG. 11 is a perspective view, in a partially disassembled condition, of the main tilt shaft for the chair and its connection to a biasing unit.
Figure 12:
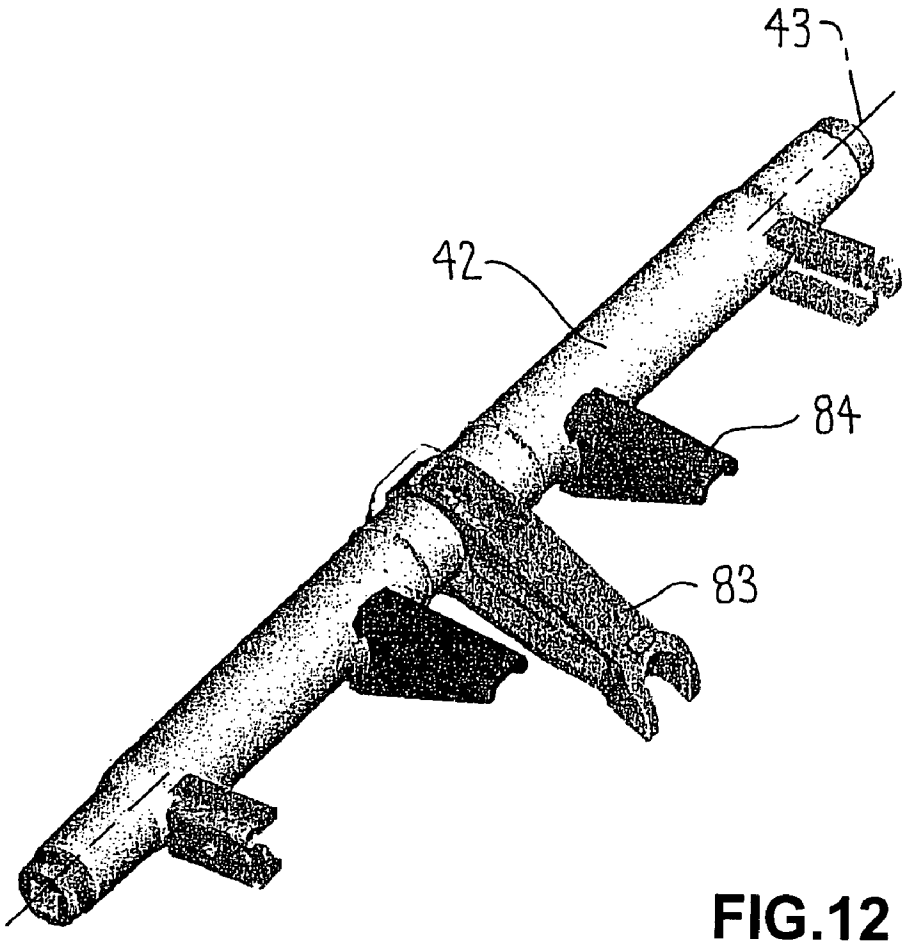
FIG. 12 is a perspective view of the assembled tilt shaft arrangement of FIG. 11.

The housing 41 functions as an enclosure for a conventional biasing or spring mechanism for normally urging the back assembly 19 into an upright position. In the present invention, and as illustrated in FIGS. 11–12, the chair employs a biasing or spring mechanism 81 which is disposed within the interior of the control housing 41 and includes a spring 82, namely an elongate bar-like torsion spring in the illustrated embodiment. This torsion spring 82 has an arm 83 anchored thereto substantially at the center of the spring, which arm at its other end is stationarily interconnected to the control housing 41, typically through a manually-adjustable tensioning mechanism which permits limited swinging of the arm so as to adjust the initial torsion of the torsion spring 82. This torsion spring 82, as it projects outwardly from opposite sides of the mounting arm 83, is telescoped within the interior of coaxially aligned shaft segments which define the main tilt shaft 42, and the free ends of the torsion spring 82 are nonrotatably secured to the shaft segments defining the shaft 42. The shaft segments also have stop members 84 fixed thereto and cooperating with opposed stops (not shown) associated with the control housing 41 for defining the permissible angle of movement of the shaft 42 and of the back arrangement as coupled thereto through the upright structure. While the biasing mechanism 81 as described above represents one arrangement for effecting biasing of the chair into its normal upright position, it will be recognized that numerous other biasing mechanisms employing other types of spring devices are well known and hence could be usable with the chair of the present invention.

To control tilting of the seat and back assemblies relative to the base, an improved control linkage 51 is operatively coupled between the base and the seat frame or cradle 21, and is additionally coupled to the upright arrangement 31, as explained below.

The tilt control linkage 51 according to this invention includes two substantially identical linkages which are effectively mirror images of one another and are disposed on opposite sides of the chair control housing 41 for cooperation with the respective lower upright arms 33 and cradle side frame elements 23 as associated with the same side of the chair, as described below. Only one of the linkages 51 is described, it being understood that both linkages cooperate and function simultaneously in the same manner as described.

More specifically, the control linkage 51 permits synchronized but relative tilting of the seat and back with respect to the base, and for this purpose includes a main control link or lever 52 which is elongated in the front-to-rear direction of the chair and which, at a forward end thereof, has a transverse pivot shaft 53 which is rotatably supported with an opening 54 associated with one side of the control housing 41 so as to define a transverse horizontal hinge axis 55. The hinge axis 55 is generally parallel with but spaced rearwardly and downwardly from the main tilt axis 43. The other or rearward end of the main control lever 52 also has a transversely projecting pivot shaft 56 mounting thereon a roller 57 rotatable about a transverse horizontal axis 58 which is generally parallel with but spaced rearwardly from the hinge axis 55. The roller 57 is confined for movement within an elongate slot 59 as formed in the inner side wall of the adjacent lower lever arm portion 33 of the upright side member 32. The slot 59 is elongated in the front-to-rear direction of the chair seat, and in the front-to-rear direction of the lower arm portion 33, with the longitudinal direction of the slot extending at a significant acute angle relative to the lengthwise direction of the main control lever 52 as defined transversely between the hinge axes 55 and 58.

The transverse shaft end 56 associated with the rearward end of control lever 52, in the illustrated embodiment, passes through an enlarged and elongated clearance hole 60 formed in the side element 23 of the seat cradle so as to permit access to the control slot 59 formed in the adjacent lever arm portion 33.

In addition to the control linkage 51, the synchronized but differential tilting of the seat and back with respect to the base is further controlled by a pivotal support mechanism 71 which couples the seat cradle 21 to the upright arrangement 31. The pivotal support mechanism 71 includes a pair of aligned front rollers 72 which are mounted on opposite sides of the seat cradle 21 and project outwardly from the outer side surfaces of the side frame elements 23 in the vicinity of the front ends thereof. The aligned front rollers 72 define a pivot or rotational axis 73 which extends transversely in horizontal orientation so as to be generally parallel with the tilt axis 43. A further pair of rearward rollers 74 are similarly mounted on the outer sides of the cradle side frame elements 23 and are disposed in aligned relationship so as to be rotatable about a transverse horizontal axis 75 which is generally parallel with but spaced rearwardly a substantial distance from the front roller axis 73. The rear rollers 74 are positioned adjacent the rearward ends of the cradle side frame elements 23.

The pivotal support mechanism 71 also includes a pair of elongate front slots 76 and a further pair of elongate rear slots 77 which are formed in the lower lever arms 33 for individually movably accommodating therein a respective said front or rear roller 72 or 74. More specifically, the pair of front slots 76 open inwardly in opposed relationship to one another from the inner side surface of the lower lever arms 33, and in similar fashion the pair of rear slots 77 are disposed in opposed relationship to one another and open inwardly into the respective lower lever arms 33 from the inner side surface thereof. The front slots 76 are positioned between the tilt shaft 42 and the elongate slots 59 in the front-to-rear direction of the chair seat, and the rear slots 77 are positioned rearwardly of the slots 59 but somewhat forwardly from the upper upright arms 34.

Figure 6:
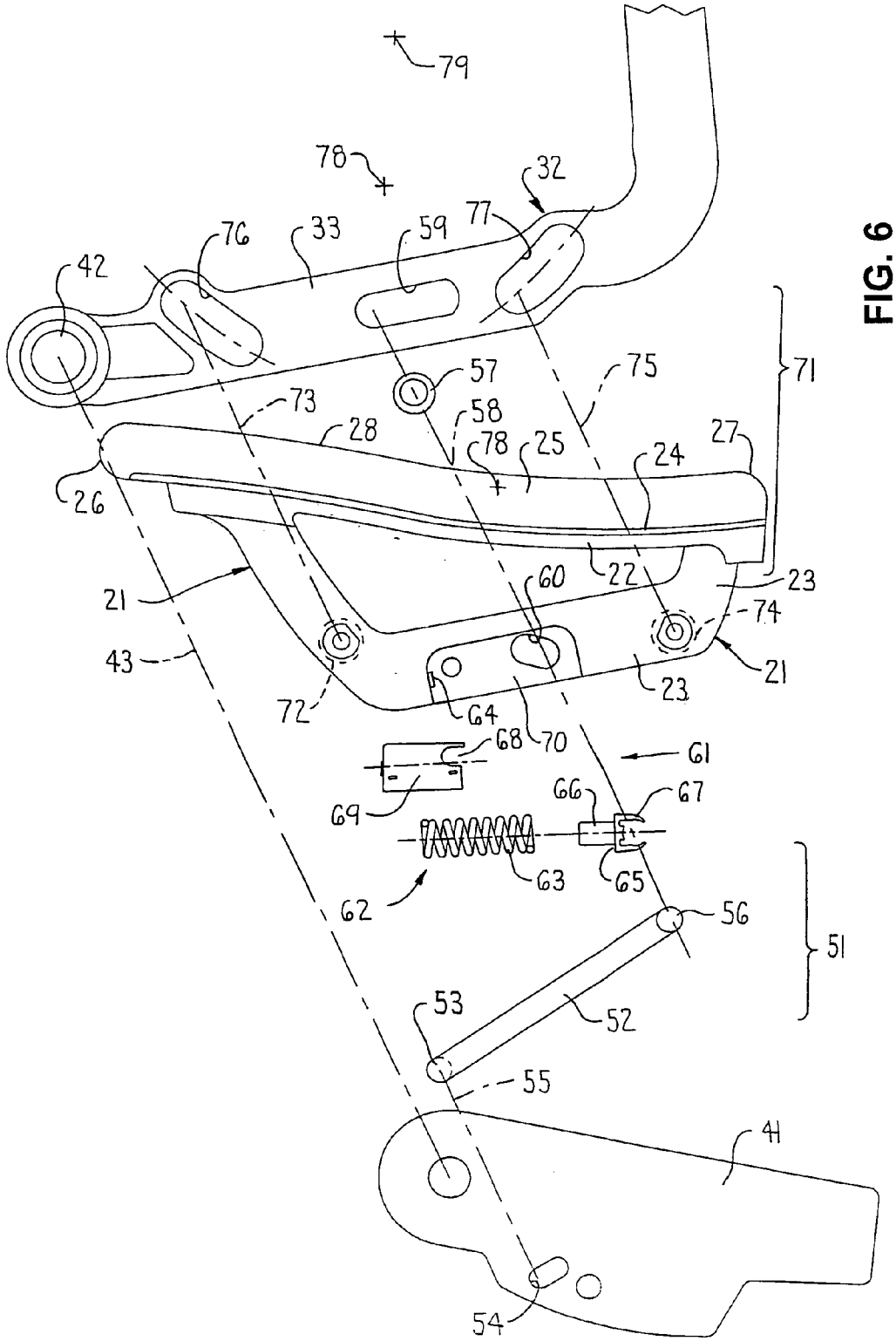
FIG. 6 is a side elevational view showing various parts of the control mechanism according to the present invention in a separated or exploded position for clarity of illustration.

The front slots 76 and the rear slots 77 are both of an upwardly-facing arcuate configuration in that they are each generated on a uniform radius generated about a common center point or axis 78 which, as illustrated in FIG. 6, is positioned at an elevation whereby this center point or axis 78 is preferably a small distance below the upper surface 28 of the seat cushion 23 when the seat cushion is not deformed, i.e., the seat is not occupied. The center point or axis 78, however, is disposed more closely adjacent the rear edge 27 of the seat cushion but is spaced forwardly therefrom so as to be, when viewed horizontally, spaced forwardly a small distance from the back 36. The center point or axis 78 is preferably oriented so as to be generally aligned with but spaced vertically downwardly from the hip point or hip axis 79 associated with the hips of the chair occupant, which hip axis 79 is always spaced upwardly a small distance above the chair seat and is always spaced forwardly a small distance (i.e., several inches) from the chair back.

In the construction of the present invention, however, the center point or axis 78 used for generating the curvature of the slots 76 and 77 is typically spaced downwardly a small distance below the upper surface 28 of the nondeformed seat cushion 23 such that, when the seat cushion 23 and the upper surface 28 thereof are deformed downwardly due to an occupant seated thereon, the upper surface 28 of the seat cushion at least in the center portion thereof directly under the occupant's hips is deformed downwardly so that the generating axis 78 for the slots 76–77 is preferably disposed at and more preferably slightly above the upper surface 28 of the occupant-deformed cushion 25, whereby the axis 78 will more closely be positioned for substantially tangential contact with the outer periphery of the occupant's hip bones. With this relationship, the occupant's hips where they contact the deformed chair seat thus remain stationary during synchronized rearward tilting of the seat and back with respect to the chair base.

In the arrangement of the present invention, the center point or axis 78 will typically be in the range of about one-half to about one inch below the upper surface 28 of the seat cushion 25 when the latter is unoccupied and hence not compressed or externally deformed.

The overall construction of the chair and the structural and functional relationships associated with the components thereof, as described above, generally correspond to the construction of the chair disclosed in Assignee's copending application Ser. No. 09/957,695, now U.S. Pat. No. 6,644,741.

According to the present invention, the control linkage 51 includes a lost motion connection 61 cooperating between the seat cradle 21 and the control lever 52 for permitting limited relative motion therebetween, such as during tilting of the seat-back arrangement 17. This lost motion connection 61 includes a spring or biasing arrangement 62 associated therewith for creating a controlled restraint against relative tilting between the seat cradle 21 and the back upright structure 31 during rearward tilting of the seat-back arrangement 17.

The lost motion connection includes the clearance opening 60 which opens sidewardly through the base leg of the seat cradle. The opening 60 is positioned approximately midway between the front and rear cradle rollers 72 and 74 respectively, and as illustrated is formed generally as a slot which is elongated generally in a front-to-back direction. The transversely projecting pivot shaft 56 as provided at the rearward end of the control lever 52 projects sidewardly through the opening 60 so that the end of the pivot shaft 56 remote from the control lever 52 can be provided with the roller 57 thereon, the latter being engaged in the elongate slot 59 associated with the lower arm portion of the upright back structure. The lost motion connection 61 defined by the opening 60 and its cooperation with the transverse pivot shaft 56 hence permits a limited amount of relative movement, principally in a front-to-back direction, between the control lever 52 and the seat cradle 21.

The spring or biasing connection 62 also cooperates between the seat cradle 21 and the rearward end of control lever 52 to restrain relative movement of the pivot pin 56 within the opening 60 and at the same time provide control over the positioning of the seat cradle 21 relative to the back upright structure 31.

The spring unit 62 in the illustrated embodiment includes a coil spring 63, specifically a compression-type coil spring which is elongated generally in a front-to-back direction and is substantially carried on the lower arm of the seat cradle. The elongate coil spring 63 has one end thereof, namely the forward end in the illustrated embodiment, seated generally on a nib or projection 64 defined on the seat cradle. The elongate spring projects rearwardly from the nib 64 dominantly in a horizontal direction and the rearward end of the spring 63 is seated on an end plate 65, the latter having a short cantilevered guide pin 66 protruding centrally forwardly thereof for guiding confinement within the interior of the coil spring 63 adjacent the rearward end thereof. The end plate 65 also mounts thereon a rearwardly projecting clevis 67 which projects at least partially around and rotatably embraces the transversely projecting pivot shaft 56. The clevis 67 can be constructed of a suitable plastics material having sufficient resiliency to enable the split forklike construction thereof to be resiliently snapped into engagement with the pivot shaft 56.

The spring 63 is positioned generally within an elongate opening or cavity formed within a small housing 69, the latter being at least partially seated within a shallow recess 70 defined on one side of the base member of the seat cradle, with the housing 69 being suitably fixed to the seat cradle in any conventional manner, such as by screws or by any type of suitable engagement which enables the seat cradle 21 and housing 69 to be fixedly and reliably joined while permitting separation for maintenance purposes if necessary.

The housing 69 also has a transverse slot 68 therethrough which effectively sidewardly aligns with the clearance slot 60 defined in the base leg of the seat cradle 21 so as to permit the pivot shaft 56 to project therethrough while permitting relative movement therebetween.

When the seat-back arrangement is in the normal upright position, the spring 63 and the engagement of the front end thereof on the seat cradle 21 causes a forwardly-directed biasing force to be exerted on the seat cradle which tends to move the bottom portion of the seat cradle forwardly, hence causing the seat cradle to rotate in a clockwise direction (FIG. 6) relative to the upright back structure 31, thereby maintaining the pivot shaft 56 generally adjacent the rearward closed end of the clearance opening 60. This defines the normal position of the seat cradle 21 relative to the upright back structure 31 when the latter is in its normal upright position and the chair is not occupied. The springs 63, however, undergo compression during rearward tilting of the rigid upright back structure 31 so as to permit the seat cradle 21 to hence tilt relative to the seat back structure to provide synchronous but differential tilting of the seat and back. In addition, when the chair is in its normal upright position and is initially occupied, the weight of the occupant may cause the seat cradle 21 to slightly rotate downwardly and rearwardly (counter-clockwise in FIG. 6) about the axis 78 so as to effect partial compression of springs 63 and movement of the rear ends of openings 60 rearwardly away from the pivot shafts 56. Further, the springs 63 also undergo compression and permit relative tilting between the seat cradle 21 and back structure 31, specifically forward tilting of the seat cradle, in response to forward shifting of an occupant's weight on the seat member to hence permit the seat member to undergo a limited forward tilt (counter-clockwise in FIG. 6) from its normal position. These functions, which occur as a result of the lost motion connections 61 and the associated spring connections 62, as provided on opposite sides of the chair, are explained in greater detail below.

Figure 7A:
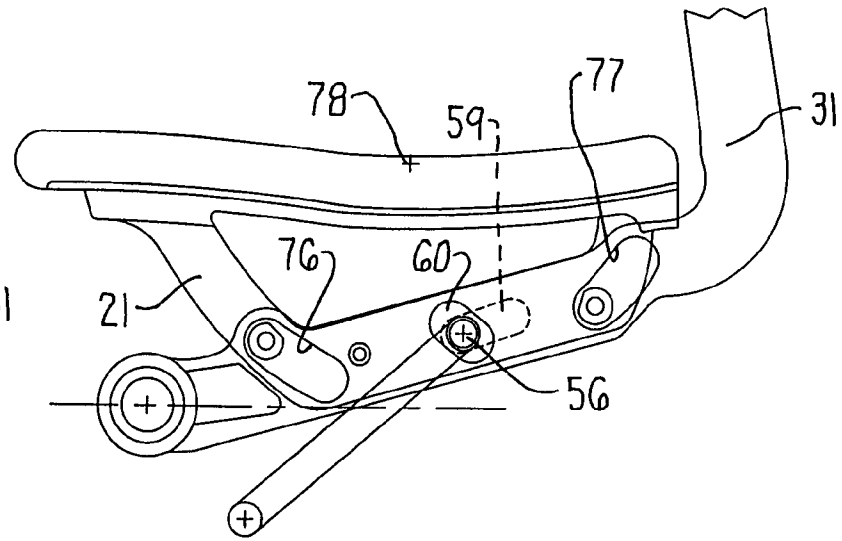
FIG. 7A is a fragmentary diagrammatic side view which shows the relationship of the seat and back when in the normal upright position.
Figure 7B:
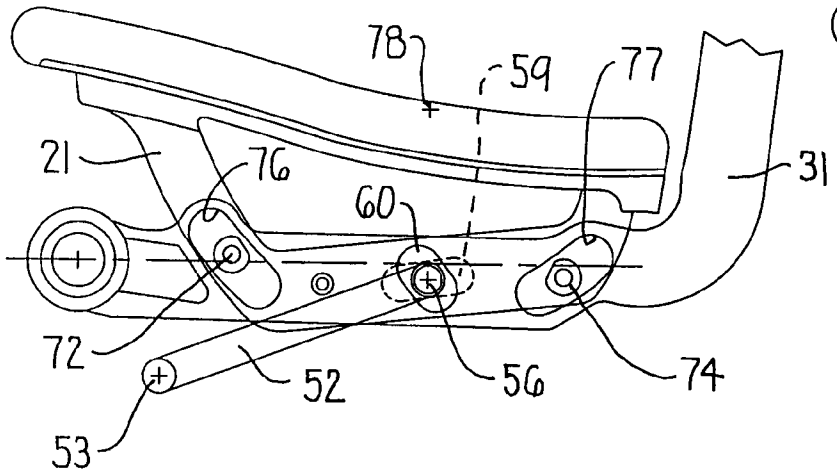
FIG. 7B is a fragmentary diagrammatic side view which shows the relationship of the seat and back when in the maximum rearward tilt position.

When the chair is in an unoccupied condition, the seat-back arrangement 17 will be maintained in its generally upright or forward position due to the resilient urging of the spring or biasing mechanism 81 associated with the control assembly, which biasing mechanism always urges the seat-back assembly in a generally vertical direction about the tilt axis 43 (counter-clockwise in FIGS. 6 and 7A) into engagement with a suitable stop which defines the upright position, as shown in FIG. 7A. In this disposition, the springs 63 urge the seat cradle 21 in the opposite (i.e. clockwise in FIG. 6) direction so that rollers 72, 74 are generally engaged with the forward ends of slots 76, 77, and pivot shafts 54 are positioned adjacent the rearward ends of clearance slots 61A. When the chair in the upright position is occupied, however, the occupant's weight may cause the seat cradle 21 to slightly rotate (counterclockwise in FIG. 6) a small extent in opposition to the urging of the springs 63. In this latter position, the occupant may elect to tilt rearwardly by applying suitable backward pressure against the chair back, causing the upright back structure 31 to tilt rearwardly (clockwise in FIGS. 6 and 7) about the tilt axis 43 against the urging of the biasing or spring device 81. This rearward tilting of the upright arrangement 31 about tilt axis 43 causes the lower upright arms 33 to vertically swing downwardly about axis 43, which causes the main control lever 52 to also swing downwardly (FIG. 7B), and simultaneously causes the roller 57 to move rearwardly along the slot 59 defined in the lower upright arm 33. The downward swinging of upright lower arms 33 also causes the seat cradle 21 to be swung downwardly therewith due to the engagement of the rollers 72 and 74 within the respective slots 76 and 77. This connection tends to tilt the seat cradle 21 downwardly at the same rate as the back upright arrangement 31. Simultaneous with this latter movement, however, the pivot shaft 56 tends to move toward the rearward closed end of the clearance slot 60 and the downward load on the seat cradle caused by the seated occupant causes the seat cradle rollers 72 and 74 to move rearwardly along the respective slots 76 and 77. Due to the arcuate curvature of the slots 76–77 as generated about the axis 78, this causes the seat cradle 21 to effectively rotate about the axis 78 relative to the lower upright lever arms 33 as the latter swing downwardly about axis 43. This relative rotation of the seat cradle 21, however, is in the opposite rotational direction to that of the lower upright arms 33, although at a lesser rate, so that the overall net effect is that the seat cradle 21 also effectively tilts rearwardly simultaneous with the rearward tilting of the back upright arrangement 31, except that the rearward tilting of the seat cradle 21 occurs at a lesser rate of movement.

When the upright arrangement 31 is returned toward its upright position (FIG. 7A), the swing of the upright 31 (counterclockwise in FIGS. 6 and 7B) causes the pivot shaft 56 to act against the coil springs 63, which in turn act against the seat cradle 21 so that it angularly moves (clockwise in FIGS. 6 and 7B) relative to upright 31 so as to return to its normal position wherein the rollers 72, 74 are positioned at or adjacent the forward ends of slots 76, 77.

During the aforementioned rearward tilting of the upright 31, the tilting of the seat cradle 21 relative to the back assembly (i.e. upright 31) occurs about the axis 78 which is approximately vertically aligned with but spaced downwardly below the occupant's hip axis 79, with the center of relative tilting movement 78 being positioned adjacent and typically slightly above the deformed upper surface 28 of the seat cushion so that this tilt axis 78 is positioned to approximately transversely intersect the rounded exterior profile of the occupant's hip bones whereby, during the rearward flexing of the occupant's upper body portion about the hips relative to the lower body portion, the movement of the body closely conforms with the simultaneous but relative tilting movements of the back and seat so as to permit comfortable disposition of the occupant on the seat without undergoing significant relative sliding at the contact areas. At the same time the rearward tilting permits the occupant's knees to readily flex in an opening direction while the occupant's feet remain properly and comfortably engaged with the floor with overall rearward tilting of the occupant being permitted due to rearward flexing of the occupant's legs about the ankles.

The control linkage 51 of the present invention also permits the seat cradle 21 to rock or rotate through a small angle about the axis 78 in a direction which permits the front edge 26 of the seat cushion to be depressed, even though the upright structure 31 is maintained stationary.

Figure 7C:
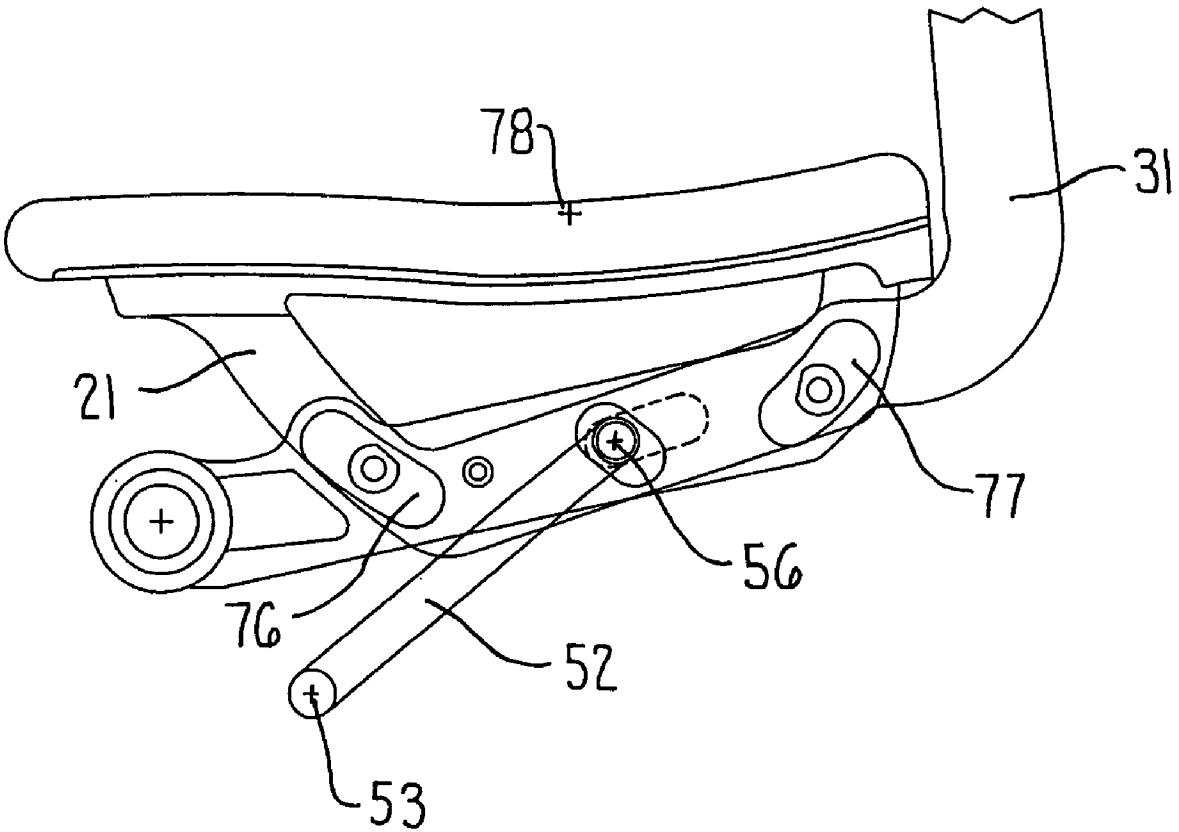
FIG. 7C is a side view corresponding to FIG. 7A but which diagrammatically depicts the relationship of the seat and back when the back is in the normal upright position but the seat is in the forward tilt position due to forward leaning of the seated occupant.

More specifically, if the chair occupant leans forwardly in the chair or shifts his/her body weight onto the front portion of the chair seat, which force must be sufficient to overcome the biasing of the springs 63, then the seat cradle 21 rotates about the axis 78 in a direction whereby the rollers 72 and 74 move rearwardly of their respective slots 76, 77 (counterclockwise in FIG. 6), which pivoting of the seat cradle causes the springs 63 to be compressed a limited extent. Such tilting of the seat cradle and lowering of the front edge of the seat, as shown in FIG. 7C, can be accomplished wholly independently of the back and of the upright structure, the latter typically being maintained in the stationary position when the occupant effects forward tilting of the seat.

When the extra occupant-created downward force imposed on the front of the chair seat is relieved or shifted rearwardly, the compression force of the springs 63 acting against the seat cradle 21 is sufficient to effect reverse rotating of the seat cradle 21 back to its normal position with respect to the upright 31.

Figure 8:
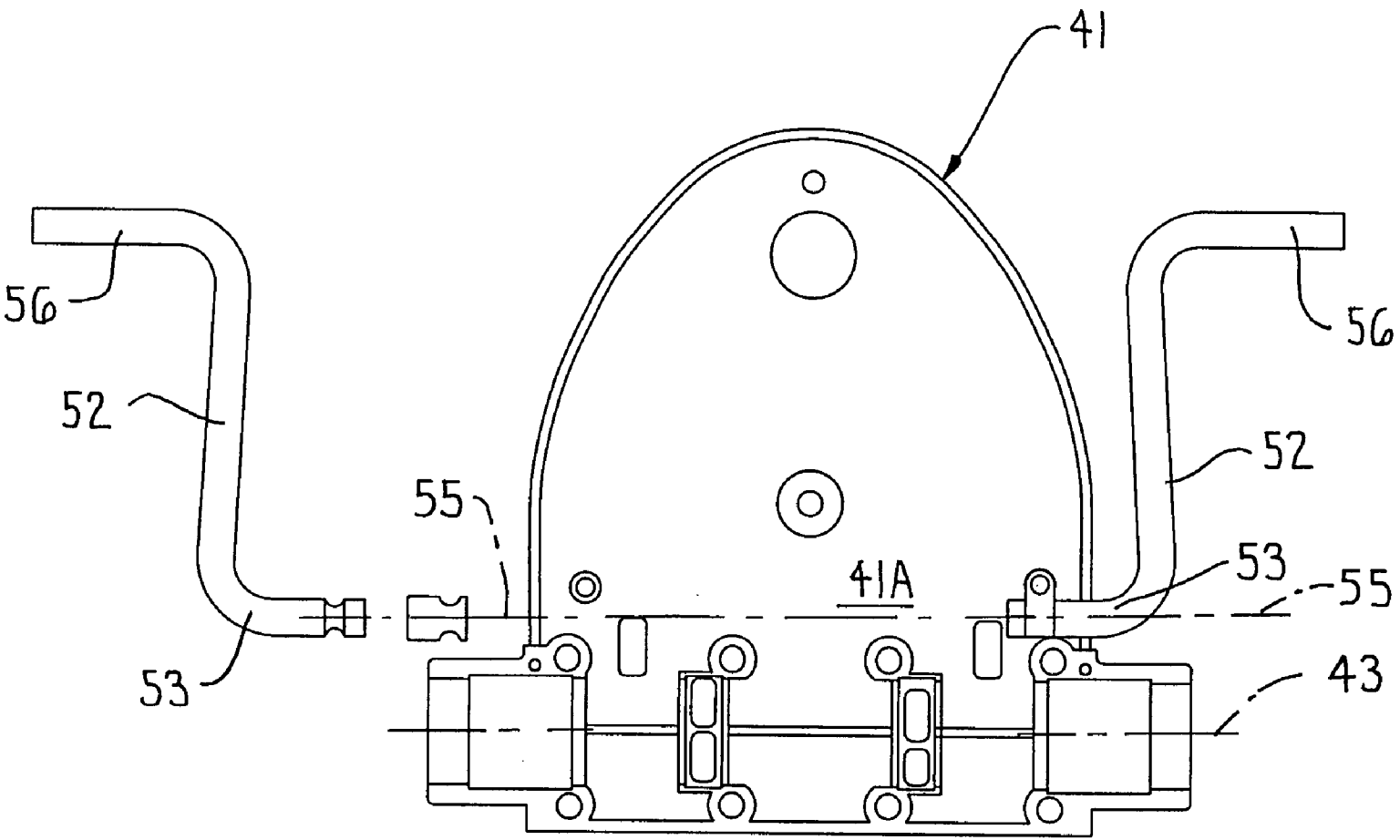
FIG. 8 is a bottom view showing the connections between the control housing and seat cradle.
Figure 9:
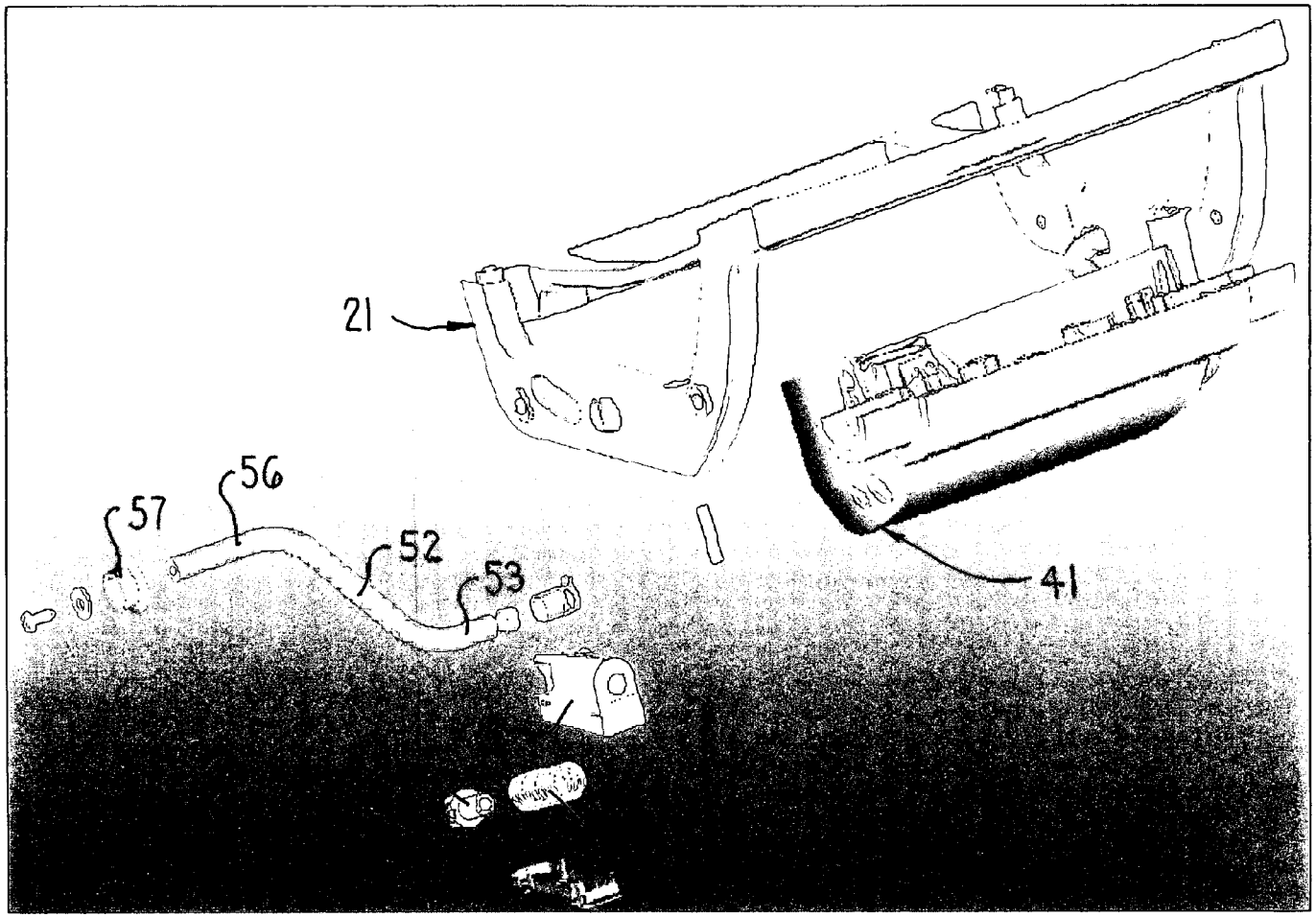
FIG. 9 is an exploded perspective view showing the seat cradle, the control housing and the control link arrangement.
Figure 10:
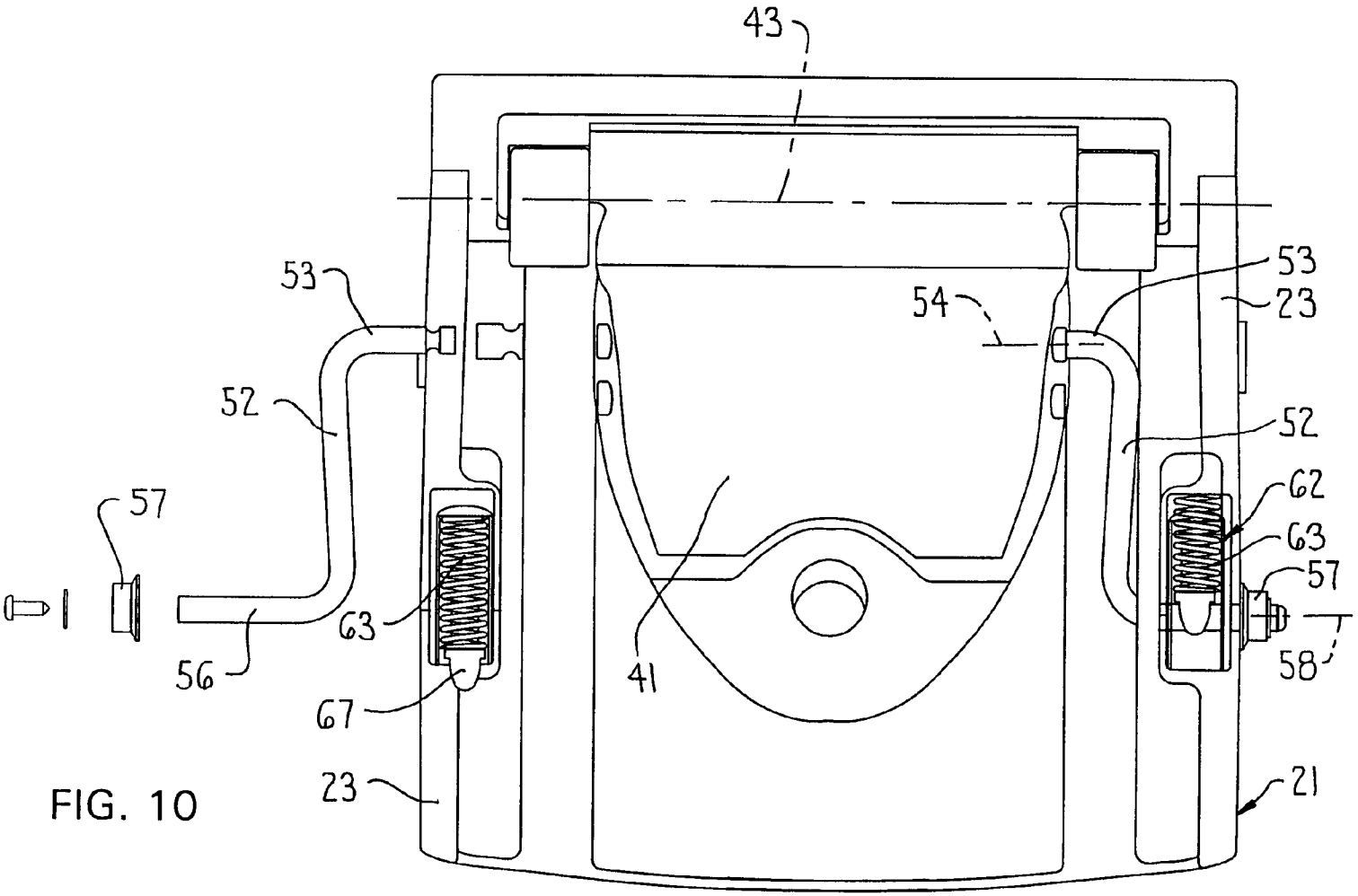
FIG. 10 is a top view of the control housing and showing its relationship to the control links positioned on opposite sides thereof.

With the structural arrangement of this invention as described above, the pivot shaft 53 is preferably formed as a short cantilevered stub shaft which is fixed to the forward end of the respective control link 52 so as to define the hinge axis 55 which is stationarily fixed relative to the upright pivot axis 43 due to the stub shafts 53 (FIG. 8) as disposed on opposite sides of the chair protruding inwardly in aligned relation for rotative support on opposite sides of the control housing 41. Thus, there is no need for a separate cross shaft for defining the axis 55 and extending across the interior of the control housing, thereby providing additional space within the interior 41A of the control housing 41 and thereby simplifying the structure interiorly thereof.

While the invention as described above illustrates the seat defined by a seat cushion 25 positioned on a seat shell, it will be appreciated that the seat may be defined by a sheet of flexible or elastic fabric (i.e. mesh or membrane) which, in a nonoccupied position of the chair, correspond generally to the upper surface of the cushion, with the fabric deforming and functioning in the same manner as the upper surface of the cushion when the chair is occupied.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A chair comprising:

a base;

a deformable seat member positioned above the base and having an occupant-deformable upper surface disposed for engagement with a chair occupant, said seat member being mounted on a seat frame;

a back member projecting upwardly from adjacent a rear edge of the seat member;

a rigid upright structure connected to said base for vertical pivoting movement about a first substantially horizontal pivot axis which is positioned below said seat member and extends transversely relative thereto, said upright structure including an upright part which projects upwardly adjacent the rear edge of said seat member and which mounts said back member thereon;

a pivot structure connected between said seat frame and said upright structure for permitting said seat member to pivot relative to said upright structure about a second substantially horizontal axis which is generally parallel with but displaced upwardly and rearwardly from said first axis, said second axis being positioned at an elevation at or only a small distance below the upper surface of the seat member when the seat member is not deformed by a seated occupant; and a control linkage connected between said base, said seat frame and said upright structure for causing the seat member to tilt relative to the upright structure in one rotational direction about said second axis in response to rearward tilting of said upright structure in the opposite rotational direction about said first axis;

said control linkage including an elongate rigid control link which at one end is solely pivotally connected to said base and at the other end is connected to said upright structure for relative pivoting and translating movement therebetween, and a spring unit cooperating between said seat frame and said other end of said control link for permitting the seat frame to rotate relative to said upright structure in said one rotation direction when the upright structure is tilted rearwardly in said opposite rotational direction.

2. A chair according to claim 1, wherein:

said elongate control link is pivotally connected at a front end thereof to said base about a third generally horizontal pivot axis which is substantially parallel with and fixed relative to said first axis, a rearward end of said control link defining a fourth substantially horizontal pivot axis which is parallel with but spaced rearwardly from said third pivot axis, and a guide structure associated with said control link at said fourth pivot axis and disposed in pivoting and translating engagement with said upright structure.

3. A chair according to claim 2, wherein:

a transverse pivot shaft defining said fourth axis is mounted at the rearward end of said control link and projects through a clearance opening formed in said seat frame, and said spring unit acting against the pivot shaft to normally urge the pivot shaft toward a rearward side of said clearance opening, whereby forward shifting of an occupant's weight on the seat member causes the seat frame to rock downwardly about said second pivot axis to lower the front edge of the seat member and to cause the pivot shaft to relatively move forwardly of said clearance opening against the urging of said spring unit.

4. A chair according to claim 3, wherein:

said upright structure includes a lower lever part which is disposed below said seat member and which at a forward end is hingedly supported on said base for pivoting about said first pivot axis, said lower lever part adjacent a rearward end thereof being rigidly joined to said upright part, said lower lever part having an elongate guide slot formed therein and elongated in a front-to-back direction of the chair seat, and said guide structure being mounted on said pivot shaft and positioned within said guide slot for translating movement in the elongate direction thereof; and said pivot structure includes front and rear elongate arcuate slots formed in said lower lever part, said front and rear arcuate slots being generated about said second pivot axis, and said seat frame mounting thereon front and rear rollers which are confined in the respective front and rear arcuate slots of said lower lever part for movement along the arcuate slots to permit tilting of the seat frame and of the seat member mounted thereon about said second pivot axis.

5. A chair comprising:

a base;

a deformable seat member positionable above said base and having an occupant-deformable upper surface disposed for engagement with a chair occupant, said seat member being mounted on a seat frame;

a back member projecting upwardly from adjacent a rear edge of the seat member;

a rigid upright structure connected to said base for vertical pivoting movement about a first substantially horizontal pivot axis which is positioned below a front portion of said seat member and extends transversely thereto, said upright structure including a lower lever part which at a forward end is pivotally joined to said base for pivoting about said first pivot axis and which projects rearwardly beneath the seat member and at a rearward end thereof is rigidly joined to an upright part which projects upwardly adjacent the rear edge of said seat member and which mounts said back member thereon;

a motion-permitting structure connected between said seat frame and said upright structure for permitting said seat member to move relative to said upright structure; and a control linkage connected between said base, said upright structure and said seat frame for causing the seat member and its seat frame, when the upright structure is tilted rearwardly and downwardly about said first pivot axis, to synchronously tilt rearwardly with the upright structure but at a lesser tilt rate;

said control linkage including an elongate control link which at a front end is supported on said base for pivoting about a second transverse axis, said control link projecting rearwardly and at a rearward end thereof being pivotally joined at a third transverse axis to a rearward end of an elongate compression spring, said compression spring being elongate forwardly from said third axis and at a forward end thereof being supportingly seated on said seat frame, said control linkage also including a guide member coupled to the rear end of said control link at said third pivot axis and disposed in front-to-back moving guided engagement with the lower lever part of said upright structure, whereby downward rearward tilting of said upright structure about said first axis causes a corresponding tilting of said seat frame and said seat member mounted thereon through a smaller angle and causes compression of said spring; and a biasing device cooperating with the upright structure for normally urging the upright structure and the back member mounted thereon into an upright position.

6. A chair according to claim 5, wherein:

said second pivot axis associated with the front end of said control link is restrained against transverse translation relative to said base.

7. A chair according to claim 6, wherein said lower lever part includes a pair of sidewardly-spaced but generally parallel lever members which are disposed under and positioned adjacent opposite sides of the seat member, said seat frame including a pair of side frame parts which are sidewardly spaced apart and are positioned between and respectively adjacent the lower lever members, said base including a control housing positioned generally between the side frame parts, and said seat frame being mounted on said lever parts for permissible pivoting movement of the seat frame relative to the upright structure about a fourth pivot axis which extends generally parallel with said first pivot axis, said fourth pivot axis being disposed generally within a transverse vertical plane which passes through a hip axis of the chair occupant but being positioned vertically downwardly a substantial distance below the occupant's hip axis.

8. A chair according to claim 7, wherein:

said fourth axis is positioned below the upper surface of the seat member when the chair is unoccupied, and upwardly relative to said first pivot axis.

9. A chair comprising:

a base;

a seat member positioned above said base and mounted on a seat frame;

a back member projecting upwardly from adjacent a rear edge of the seat member;

a rigid upright structure connected to said base for vertical pivoting movement about a first substantially horizontal pivot axis which is positioned below a front portion of said seat member and extends transversely relative thereto, said upright structure including an upright part which projects upwardly adjacent the rear edge of said seat member and which mounts said back member thereon;

a pivot structure connected between said seat frame and said upright structure for permitting said seat member to pivot relative to said upright structure about a second substantially horizontal axis which is generally parallel with but displaced upwardly and rearwardly from said first axis;

a control linkage connected between said base, said seat frame and said upright structure for causing the seat member and said seat frame, when the upright structure is tilted rearwardly and downwardly about said first pivot axis, to synchronously tilt rearwardly with the upright structure but at a lesser tilt rate, said control linkage including an elongate control link which at one end thereof has solely a first pivot connection to said base defining a third transverse pivot axis which is stationarily positioned relative to said first axis and at the other end thereof has first and second lost-motion pivotal connections to said seat frame and said upright structure respectively, said first and second lost-motion pivotal connections defining a fourth transverse pivot axis which extends generally parallel with said first pivot axis;

said first lost-motion pivotal connection cooperating with said seat frame for permitting the seat frame to pivot a limited amount relative to said upright structure about said second axis to permit limited lowering of the front portion of the seat member; and said second lost-motion pivotal connection cooperating with said upright structure for permitting said fourth pivot axis to move transversely relative to said upright structure as the control link is swingably moved about said third axis due to occupant induced swinging of said upright structure about said first axis.

10. A chair according to claim 9, wherein said first lost-motion pivotal connection includes a first elongate slot formed in said seat frame and projecting generally in a front-to-rear direction for permitting displacement of said fourth pivot axis along said first slot.

11. A chair according to claim 10, including a biasing device which cooperates with said first lost-motion pivotal connection for normally urging said fourth pivot axis toward a rearward end of said first slot, whereby application of increased external force to the front portion of the seat member causes the seat frame to pivot downwardly on the upright structure about said second axis and simultaneously moves said first slot rearwardly against the urging of said biasing device, said biasing device assisting in returning the seat frame to its normal position relative to the upright structure.

12. A chair according to claim 9, wherein a spring device cooperates with the first lost-motion pivotal connection for imposing a biasing force on the seat frame which opposes downward tilting thereof as caused by forward shifting of the occupant's weight.

13. A chair according to claim 9, wherein said first lost-motion pivotal connection includes a pivot shaft which defines said fourth pivot axis and which is transversely movable within a transversely elongate clearance slot formed in said seat frame, and a spring device cooperating with the pivot shaft for normally urging the pivot shaft toward one end of the slot while permitting the pivot shaft to be relatively moved away from said one end when the front portion of said seat member is tilted downwardly due to forward shifting of the occupant's weight.

14. A chair according to claim 13, wherein the spring device reacts directly between said seat frame and said pivot shaft and urges the seat frame into a predefined position relative to the upright structure when the latter is in its normal upright position.

15. A chair according to claim 13, wherein said transverse pivot shaft is carried on the rearward end of said control link and mounts thereon a guide member which is movable along an elongate slot defined in said upright structure.

* * * * *